US007387339B2

(12) United States Patent
Bykov et al.

(10) Patent No.: US 7,387,339 B2
(45) Date of Patent: Jun. 17, 2008

(54) SITTING DEVICE

(76) Inventors: Alexei Alexeevich Bykov, ul.Textilschikov, d.5, kv.17, 153040, Ivanovo (RU); Alexandr Nikolaevich Novoselsky, ul.Suvorova, d.38 kv.73, 153040, Ivanovo (RU); Andrei Rufovich Gruzdev, ul.Kukonkovikh, d.102, kv.44, 153040, Ivanovo (RU)

( * ) Notice: Subject to any disclaimer, the term of this patent is extended or adjusted under 35 U.S.C. 154(b) by 0 days.

(21) Appl. No.: 10/504,666

(22) PCT Filed: Jul. 30, 2002

(86) PCT No.: PCT/RU02/00362

§ 371 (c)(1),
(2), (4) Date: Aug. 13, 2004

(87) PCT Pub. No.: WO03/068027

PCT Pub. Date: Aug. 21, 2003

(65) Prior Publication Data

US 2005/0168030 A1 Aug. 4, 2005

(30) Foreign Application Priority Data

Feb. 14, 2002 (RU) ..... 2002104693

(51) Int. Cl.

| | |
|---|---|
| ***A47C 1/022*** | (2006.01) |
| ***A47C 1/00*** | (2006.01) |
| ***A47C 1/03*** | (2006.01) |
| ***A47C 7/54*** | (2006.01) |

(52) U.S. Cl. ..... 297/312; 297/354.11; 297/411.36

(58) Field of Classification Search ..... 297/311, 297/312, 313, 314, 353, 354.11, 354.12, 297/337, 411.36, 411.27, 232, 233, 248
See application file for complete search history.

(56) References Cited

U.S. PATENT DOCUMENTS 132,762 A * 11/1872 Haupt ..... 297/354.11 X
564,588 A * 7/1896 Burgess ..... 297/312

(Continued)

FOREIGN PATENT DOCUMENTS

| | | | | |
|---|---|---|---|---|
| CH | 675194 A | * | 9/1990 | ..... 297/338 |
| GB | 2087719 A | * | 6/1982 | ..... 297/354.11 |
| GB | 2176396 A | * | 12/1986 | ..... 297/423.12 |

OTHER PUBLICATIONS

International Preliminary Examination Report for PCT/RU02/00362 Feb. 16, 2004.

*Primary Examiner*—Rodney B. White
*Assistant Examiner*—Stephen Vu
(74) *Attorney, Agent, or Firm*—John D. Gugliotta, PE, Esq

(57) ABSTRACT

The invention relates to furniture, in particular to sitting devices and can be used as a work chair or therapeutic furniture.

The aim of said invention is to develop a sitting device which would make it possible to efficiently relieve the backbone in a sitting posture taking into consideration individual morphological and functional asymmetries, thereby normalizing the work of other organs and systems of an organism, first and foremost the organs of the small pelvis, optimizing the "turtuosity" of the backbone associated with constitutional and geophysical factors.

The sitting device comprises a support provided with a base in a top part thereof, on which a seat is mounted; said seat consists of two parts pivotally arranged on a horizontal axis which lies on a frontal plane and is fixed to the base, each part of the seat being provided with adjusters of the rotational motion thereof with respect to the horizontal axis; the device can be provided with a back and a bracket bearing a backrest, comprising two supporting elements pivotally arranged on the horizontal axis which lies on the frontal plane and fixed to the bracket, each supporting element of the backrest being provided with adjusters of the rotational motion thereof with respect to the horizontal axis.

10 Claims, 4 Drawing Sheets

U.S. PATENT DOCUMENTS 1,976,326 A * 10/1934 Carlton ..... 297/312
2,799,323 A * 7/1957 Berg ..... 297/312
3,749,442 A * 7/1973 Berg et al. ..... 297/312
5,024,485 A 6/1991 Berg et al. ..... 297/312
5,288,127 A 2/1994 Berg et al. ..... 297/312
5,577,801 A * 11/1996 Glockl ..... 297/312 X
5,580,128 A * 12/1996 Johnson et al. ..... 297/314
5,664,842 A * 9/1997 Tseng ..... 297/411.36
5,713,632 A * 2/1998 Su ..... 297/312
5,913,568 A * 6/1999 Brightbill et al. ..... 297/258.1
6,139,095 A * 10/2000 Robertshaw ..... 297/312 X
6,139,109 A 10/2000 Lajoie ..... 297/452.28
6,340,207 B1 * 1/2002 Brightbill et al. ..... 297/258.1
6,357,827 B1 * 3/2002 Brightbill et al. ..... 297/312
6,578,918 B1 * 6/2003 Rinne et al. ..... 297/312 X
6,595,586 B2 * 7/2003 Brightbill et al. ..... 297/312
6,866,340 B1 * 3/2005 Robertshaw ..... 297/312
6,893,090 B1 * 5/2005 Van Deursen et al. ..... 297/312
7,090,303 B2 * 8/2006 Kropa ..... 297/312 X
2006/0152053 A1 * 7/2006 Kim ..... 297/312

* cited by examiner

SITTING DEVICE

RELATED APPLICATIONS

The present invention is a National Phase filing of a filing under the Patent Cooperation Treaty No. PCT/RU02/00362, filed on Jul. 30, 2002, and claiming benefit of a Russian Federation patent having a priority date of Feb. 14, 2002, incorporated by reference herein.

TECHNICAL FIELD

This invention relates to furniture, in particular to sitting devices, and can be used as a work chair of operator, dispatcher, car driver or train operator, pilot, etc., or as therapeutic furniture used both domestically and at various institutions (chair, stool, school furniture, bench, etc.).

BACKGROUND OF THE INVENTION

All inner organs, central, peripheral and vegetative nervous system, vascular and lymphatic systems and muscular ligamentous apparatus are somehow or other concerned with human bony skeleton. From the position of biomechanics, the head, neck, trunk and extremities of a human are joined in statokinematic regions by the bone and muscular ligamentous structures. The most important skeleton formation is considered to be spinal column or backbone. The backbone performs protective, support and motor functions and is the main structure-forming organ. From the position of biomechanics, the backbone, pelvis and low extremities represent a whole statokinematic block.

Disorders in some part of this system lead to the disorders of functioning of other structures.

The spine column, functioning as a whole organ, represents a chain of connected vertebra-motor segments (VMS). VMS are joined by the two adjacent vertebras with the intervertebral disk, muscular ligamentous apparatus, lying between them. Movements in the area of VMS can be performed in normal, decreased and increased ranges, as well as in the zone of micro movements ("model" of joint). The backbone has the so-called physiological curvatures in sagittal plane—cervical and lumbar lordosis, thoracic and sacrococcygeal kyphosis. Curvatures in frontal plane are usually regarded as scoliosis or scoliosion, i.e. pathology, although many investigation works have proved that the minimal degree of curvature of the frontal plane is typical of all people and is normal. The combination of these disorders in the horizontal plane is regarded as asymmetric position of structures of the shoulder-girdle with respect to pelvis or as "torsion".

The pelvis joins sacrum, adherent pair iliacs, ischial and pubic bones in a single block, having three joints: symphysis pubis, sacroiliac, right and left joints. Movements in these joints can be performed either within normal range or within limited or enlarged range (micro movements, "model" of joint).

The position of sacrum, which is located between the pelvis and spine column, determines the position of pelvis (inclination, lateral inclination, tortuosity) and spine column (the intensity of its curvature in all planes). It was determined that morphometric characteristics of backbone, pelvis bones and lower extremities had "spiral" in their basis and that human muscles were united into special muscular loops interacting according to the laws of spiral.

There are constitutionally determined types of constructive approaches to human support-motor apparatus. They are realized through morphological and functional asymmetries ("?" and "S"-shape spinal curvatures, types of "torsion" of spine column, relatively and absolutely short leg, "leading" leg, "jumping" leg, "support" leg, etc.).

While keeping the position of the body (statics) and moving the body (dynamics), the intensity of physiological curvatures and frontal deviations changes, as well as the position of inner organs, nervous, vascular and lymphatic system structures.

As a rule, functional asymmetries of support-motor apparatus and biomechanical characteristics of mobility of VMS are not considered in the sphere of human activity support (furniture, work tools, clothes, etc.). In a sitting posture supporting by gluteal regions, the determining factors involve the asymmetry of position of pelvis structures in all planes, the "switch-off" of the functions of iliopsoas and gluteus muscle, as well as other muscular groups, prelum abdominale and diaphragm muscles, specifically. The sitting device with additional support (chair back, etc.) consists in switching off the antigravity function of some muscles of the spinal column. Thus, in a sitting posture (statics), the protective and support structure-forming characteristics of the spinal column and all the biokinematic chain backbone-pelvis-lower extremities change and the load upon osteochondrous structures of the backbone, especially upon the lumbar VMS, increases.

The resulting influence of geophysical factors upon the human body, taking into consideration structural and functional asymmetries typical of the body, can be represented in the form of a long-pitch screw. Body constitution correspondingly counteracts the screwing effect, pressing the human body to the earth, in order to maintain the balance state. The form of spring and spiral mostly satisfies this condition.

Patent FR, A, 2589701 protects a device which provides optimal position of the body and neck in a sitting posture, comprising a supporting element of approximately rectangular form in frontal plane with front, supporting and back base layers, possessing different physical properties, provided with a case and fastening means.

Patent RU, 01, 2170539 protects an analogous device comprising a supporting element, consisting of two layers of symmetrical form or having the form of an airplane wing profile, with the depth of flexure from 0 to 50 cm in horizontal cross section, ratio of rigidity of layers—from 1:1.2 to 1:3. The back base layer has a vertical trough 2-8 cm wide and 0.5-3 cm deep.

These devices enable to ease down the lumbar muscle tension in a sitting posture, however are far from providing "optimal biomechanics of the body and neck", which is declared by the applicants.

Patent RU, 01, 2063646 protects a sitting device, comprising a support, provided with a base in a top part thereof, on which a seat is mounted; the sitting device comprises also a backrest, headrest, armrest, foot loaders, underarm rests and seat belt. The operator can be working in a sitting position, can be resting in reclining and lying posture and performing physical exercises.

This engineering solution is taken as prototype of the present invention.

This engineering solution enables to ease down the fatigability in the sitting posture, however, as all other known engineering solutions, it does not consider the peculiarities of biomechanics of support-motor apparatus and other systems of human organism—mobility of osteochondrous ligamentous junctions in the region of micromotions ("model" of joint), constitutionally determined morphological and functional asymmetries of support-motor apparatus of a human; in a sitting posture resting upon buttocks, the main muscle forming a lumbar lordosis (iliopsoas muscle) is in a relaxed state, gluteus and prelum abdominale muscles are "switched off"; depending on the inclination angle of pelvis forward or aside, pelvis "tortuosity", unequal distribution of support in the points of contact takes place, the load upon the spinal column, especially upon the lumbar part of the spine, sharply increases due to "switching off" of the lower extremities and pelvis from the biokinematic chain. It is worth mentioning thereby that the sitting posture is considered to have the biggest load for the spinal column, especially harmful is the kyphotic position of backbone, i.e. implying a slight forward inclination when the load upon the intervertebral disks, especially in the lumbar part of backbone, and upon postural muscles of spinal column increases, intra-abdominal pressure decreases because of enervation of prelum abdominale, people with low-grade fixing function of conjunctive tissue (hypermobile) experience descending of inner organs of abdominal cavity, disturbance of biomechanics of breathing, difficulty of bile outflow, etc.

"Congestive" effects in small pelvis take place, causing diseases or functional disorders of organs of small pelvis (haemorrhoid, prostatitis, impotence, frigidity, endometritis, etc., as well as dysfunction of lower parts of gastrointestinal tract, etc.); mechanical crossclamping of neurovascular trunks, coming to the lower extremities, occurs; due to the necessity to keep head in vertical position, overloads and spastic reactions occur in suboccipital group of muscles, causing impairment of blood circulation in vertebrobasilar system of vessels of the brain, feeding the brain stem and basal parts, i.e. parts comprising control centers of vital functions of the organism, although sitting with the two zones of support provided (seat and backrest), the overloads are not so pronounced, but a part of postural muscles "switches off", which leads to a non-even increase of loads upon the activated postural muscles and corresponding VMS, particularly in lumbar part; bone structures of the backbone undergo long pressure (from the backrest), which causes the formation of reversible restrictions in VMS or VMS functional blocks.

SUMMARY OF THE INVENTION

The aim of said invention is to develop a sitting device which would make it possible to efficiently relieve the backbone in a sitting posture taking into consideration individual morphological and functional asymmetries, thereby normalizing the work of other organs and systems of an organism, first and foremost the organs of the small pelvis, optimizing the turtuosity of the backbone associated with constitutional and geophysical factors.

According to the invention, the inventive sitting device comprises a support provided with a base in a top part thereof, on which a seat is mounted; said seat consists of two parts pivotally arranged on a horizontal axis which lies on a frontal plane and is fixed to the base, each part of the seat being provided with adjusters of rotational motion thereof with respect to the horizontal axis; the seat can be provided with a back and a bracket bearing a backrest, consisting of two supporting elements pivotally arranged on the vertical axis and fixed to the bracket, each supporting element of the backrest being provided with adjusters of the rotational motion thereof with respect to the vertical axis.

The applicant hasn't found any sources of information containing data on engineering solutions, identical to the claimed. In applicant's opinion, that enables to conclude that the invention conforms to the criterion "novelty" (N).

A direct technical result which may be obtained when realizing substantial features of the claimed invention is the fact that the device enables to maintain natural normal physiological state of the backbone, such as its torsion (tortuosity), i.e. a new principle for the creation of a sitting device has been taken for the first time—the principle of relieving spinal column, consisting in maintaining its tortuosity, while all the known devices, including the prototype, are associated with eliminating backbone's torsion, its detorsion.

As a result, muscular fatigue in a sitting posture sharply decreases, and remaining sat for a long time there is no need to often change posture or position (to reclining or lying), when using the device-prototype. Prevention of overload of the support-motor apparatus significantly reduces the risk of formation of various pathologies.

The applicant hasn't found any data on the influence of distinguishing features of the invention on the achievable technical result. The mentioned condition enables to conclude that the claimed engineering solution conforms to the criterion "inventive step" (IS).

BRIEF DESCRIPTION OF THE DRAWINGS

Hereinafter the invention is illustrated by detailed description of its embodiment with references to drawings as follows.

DESCRIPTION OF THE PREFERRED EMBODIMENTS

Figure 1:
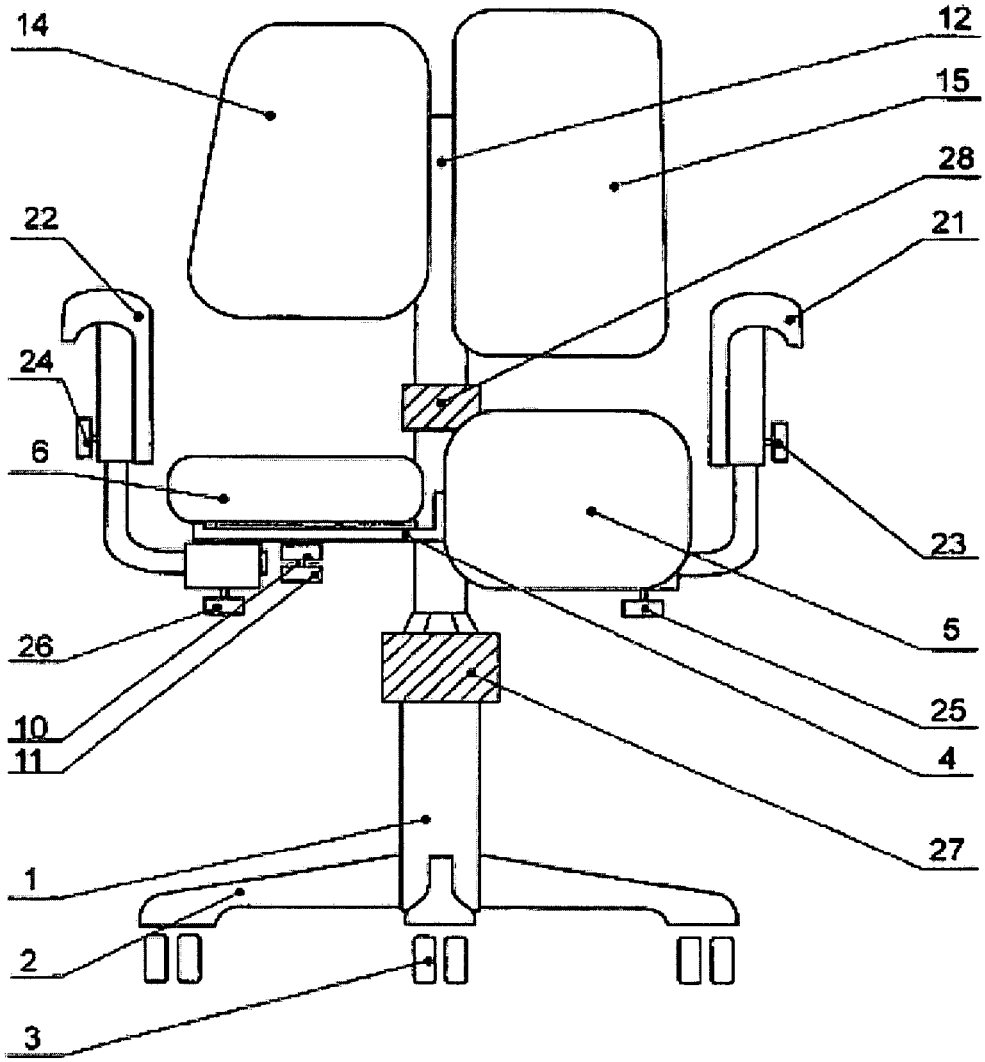
FIG. 1—front view.

The sitting device comprises a base; in the example therein under (FIGS. 1, 2, 3) the base includes a vertical telescopic support 1 with crossbar 2 in the lower part, provided with wheels or casters 3. Horizontal base 4 is connected to the upper end of support 1. A seat is mounted on base 4, comprising two parts—left part 5 and right part 6, which are pivotally arranged on axis 7; ends of axis 7 can be rotated in the holes of base 4. Left part 5 of the seat is provided with adjusters 8 and 9 of its rotation with respect to axis 7, and right part 6 of the seat is provided with adjusters 10 and 11, correspondingly.

The device is provided with a backrest, comprising telescopic bracket 12, connected with the top part of support 1 by means of pivot 13, and a backrest support, the support comprising two supporting elements—right 14 and left 15. Supporting elements 14 and 15 are pivotally arranged on a vertical axis 16, and is fixed to bracket 12 in its top part. Axis 16 is thereby vertical to axis 7. Supporting element 14 is provided with adjusters 17 and 18, and supporting element 15 is provided with adjusters 19 and 20 of the rotation motion with respect to axis 16.

a means 8, 9, 10, 11 to rotate and to adjust the seat parts 5, 6 about the horizontal axis and a means 17, 18, 19, 20 to rotate and to adjust the supporting elements 14, 15 of the back rest about the vertical axis is provided by springs and pairs of screws. comprise the screw and are located, respectively, between base 4 and parts 5 and 6 of the seat, as well as between the top part of bracket 12 and supporting elements 14 and 15.

In the particular embodiment, the device is provided with armrests 21 and 22, comprising height adjusting mechanisms 23 and 24 and adjusters 25 and 26 for moving the armrests. Regulation of raising and rotation of the top part of telescopic support 1 is performed with the help of adjuster 27; regulation of raising and rotation of the top part of telescopic bracket 12 is performed by means of adjuster 28; the angle of the back is fixed by means of adjuster 29.

Figure 4:
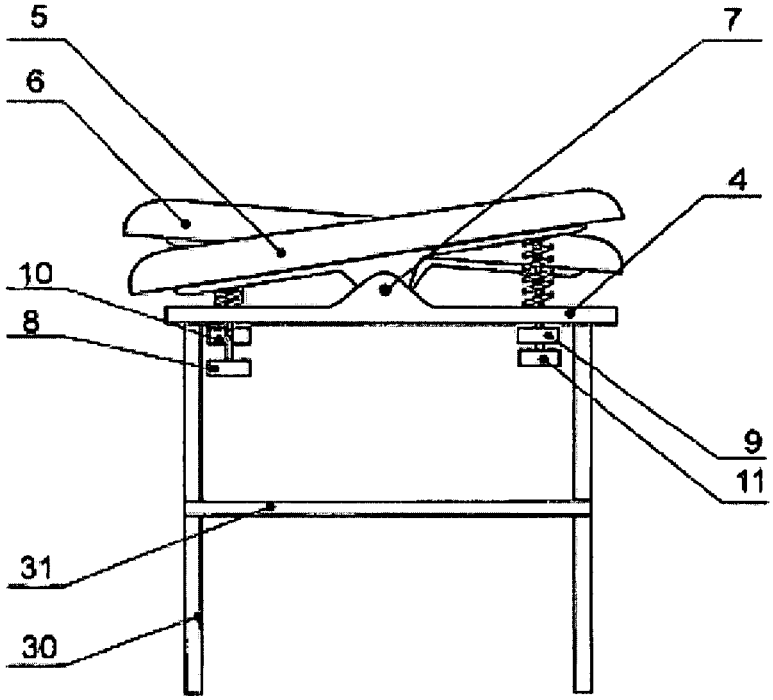
FIG. 4—device without back (stool, bench, etc.).

In the variant depicted in FIG. 4 and corresponding to the characteristics given in the first clause of the claims of the present invention, the supports represent a set of vertical legs 30, solidly fixed by horizontal bridges 31. In this variant the sitting device represents a stool or a bench or any other article of furniture, designed for sitting and having no support for the back.

The device works as follows. A person is asked to sit down onto the seat, the right buttock is located on the right part of the seat 6, and the left—on its left part 5. The position of the seat is adjusted according to person's height with the help of adjuster 27, and a convenient position of support for the back according to person's height is provided by means of adjuster 28. In order to further regulate the device, it is necessary to determine which type ("left-hander" or "right-hander") corresponds to person's support-motor apparatus. As a rule, this is determined preliminarily using known tests. Left ischial tuberosity of the left-hander shall be slightly lower than and situated in front of the right and the right ischial tuberosity—is situated higher than and behind the left. On the contrary, left ischial tuberosity of the right-hander is situated higher than and behind the right. Relative position of parts 5 and 6 of the seat by angle and, respectively, by the height of points of contact of ischial tuberosities with the parts is regulated using adjusters 8, 9, 10, 11. The position of parts 5 and 6 of the seat represented in FIG. 2 corresponds to type "right-hander", i.e. point 32 of contact of the left ischial tuberosity with part 5 of the seat is at a higher magnitude (the difference of which is shown between the dotted lines as "h" in FIG. 2). than point 33 of contact of the right ischial tuberosity with part 6 of the seat wherein point 32 is respectively situated behind point 33.

Relative position of parts 5 and 6 of the seat and position of points 32 and 33 is regulated under constant control of the magnitude of tortuosity of spinal column and, respectively, of the degree of tension of muscles connected with it. The control is performed by means of a well-known method of kyphoscoliosography. When natural position of backbone (physiological torsion) is achieved in the process of regulation, the screws of adjusters 8, 9, 10, 11 are fixed using locking elements (schematically not shown in drawings).

Figure 2:
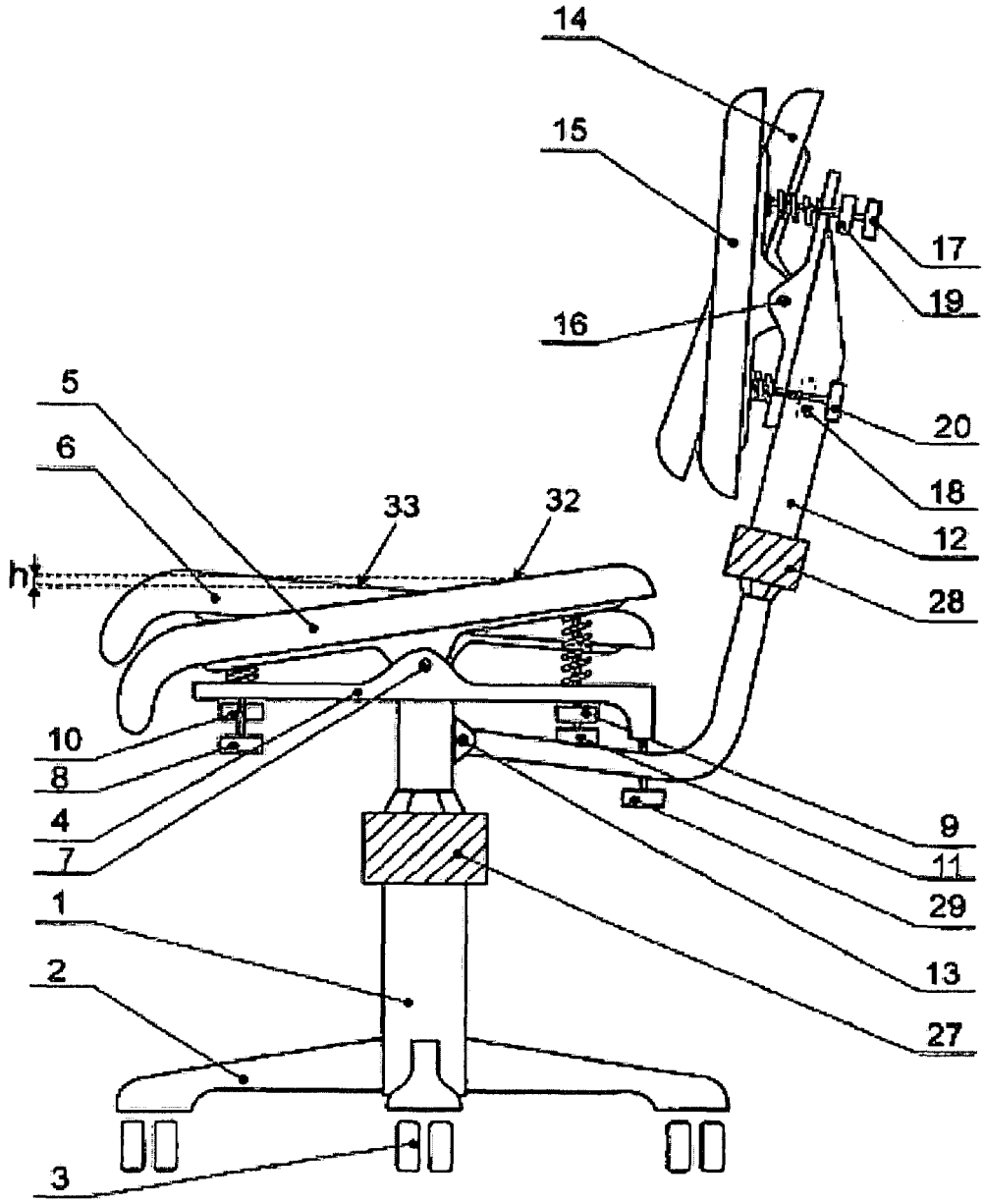
FIG. 2—right-side view (armrests not shown)
Figure 3:
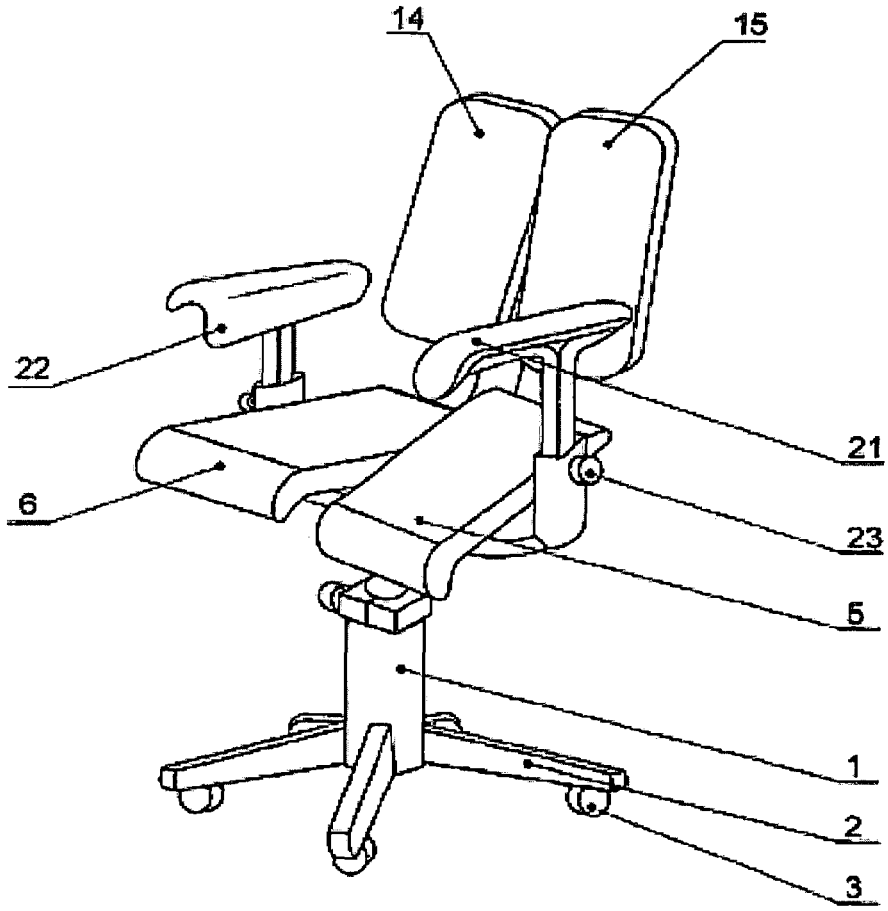
FIG. 3—device in axonometric projection.

According to FIGS. 1, 2, 3, a part of the back from the right and from the left of the spinal column is contacted with particular supporting elements 14 and 15, respectively; their position is regulated using adjusters 17, 18, 19, 20. Axis 16 is located on the level between the sixth and ninth thoracic vertebra inclusively; biomechanical center of rotation of the upper part of body with respect to its lower part is located precisely in this range; there is practically no spinal torsion in the lower part. Adjusting the position of elements 14 and 15, thoracic parts of the body are supported thereby, which provides additional support to the natural position of the backbone in the state of torsion. Owing to the claimed device, rotation of two parts of pelvis against each other and tendency to detorsion of spinal column, typical of practically all the known sitting devices, are eliminated. As a result, muscular tension is significantly reduced, unfavorable changes in the muscles of abdominal wall, diaphragm of pelvic floor are prevented and, respectively, difficulties in functioning of respiration organs, blood circulation, gastrointestinal tract and urogenital area are prevented.

INDUSTRIAL APPLICABILITY

Known constructive materials and common equipment are used for the production of the device, which stipulates that the invention corresponds to the criterion "Industrial applicability" (IA).

The foregoing descriptions of specific embodiments of the present invetion have been presented for purposes of illustration and description. They are not intended to be exhaustive or to limit the invention to the precise forms disclosed, and abviously many modifications and variations are possible in light of the above teaching. The embodiments were chosen and described in order to best explain the principles of the invention and its practical application, to thereby enable others skilled in the art to best utilize the invention and various enbodiments with various modifications as are suited to the particular use contemplated. It is intended that the scope of the invention be defined by the Claims appended hereto and their equivalents. Therefore, the scope of the invention is to be limited only by the following claims.

What is claimed is:

1. A sitting device comprising a base positioned on a top part of a support;

a seat consisting of two seat sections mounted on said base, wherein said two seat sections pivot about a horizontal axis, and wherein each of said two seat sections is pivoted about said horizontal axis by means of a pair of springs formed at a base on each of said two seat sections, said springs working in conjunction with a pair of screws and locking elements such that said screws are utilized as a means to adjust and to pivot said seat sections about said springs with respect to said horizontal axis;

wherein said screws are fixed by said locking elements.

2. The sitting device of claim 1 further comprising:

a bracket bearing a backrest;

two support elements fixed to said backrest, wherein said two support elements are pivotally arranged on a horizontal axis; and an adjustment device provided on each of said two support elements as means to rotate said support elements with respect to said horizontal axis.

3. A sitting device comprising:

a support provided with a base in a top part thereof, on which a seat is mounted; and said seat having two seat sections, each of which pivot about a horizontal axis and are fixed to said base, each of said two seat sections is provided with a means to adjust and to pivot said seat section with respect to said horizontal axis, wherein said means comprises a pair of springs formed at a base on each of two seat sections, said springs working in conjunction with a pair of screws and locking elements such that said screws are manipulated to adjust and to pivot each of said seat sections about said horizontal axis;

wherein said screws are fixed by said locking elements.

4. The sitting device of claim 3, further comprising:

said seat having a back; and a bracket bearing a backrest and having two supporting elements fixed thereto and pivotally arranged on a horizontal axis, wherein each of said supporting elements comprises a means for adjusting and rotating said supporting element with respect to said horizontal axis.

5. A sitting device comprising:

a base;

a vertical telescopic support having a crossbar, a lower portion of said crossbar is connected to said base;

a seat connected to an upper portion of said crossbar, wherein said seat is formed of a first seat section and a second seat section, each of said seat sections are arranged such that they pivot about a horizontal axis;

wherein said seat sections pivot about said horizontal axis relative to said base.

6. The sitting device of claim 5, further comprising a first adjustment means affixing said first seat part to said upper part for adjusting the rotation of said first seat part with respect to said axis.

7. The sitting device of claim 6, further comprising a second adjustment means affixing said second seat part to said upper part for adjusting the rotation of said second seat part with respect to said axis.

8. The sitting device of claim 6, further comprising:

a telescopic bracket connected with said upper part; and a backrest support affixed to said telescopic bracket.

9. The sitting device of claim 8, wherein a support element connects said backrest to said telescopic bracket, wherein said support element consists of a right half and a left half that are pivotally arranged on a horizontal axis.

10. The sitting device of claim 6, further comprising:

a first armrest;

a second armrest;

a first height adjuster provided as means for connecting said first armrest to said top part of said telescopic support and for moving said first armrest vertically;

a second height adjuster provided as means for connecting said second armrest to said top part of said telescopic support and for moving said second armrest vertically.

* * * * *